United States Patent [19]

Cooper

[11] 3,972,459

[45] Aug. 3, 1976

[54] TAPE DISPENSER HAVING SNAP LOCK CORE MEMBERS

[76] Inventor: Daniel A. Cooper, 61-29 230 St., Bayside, N.Y. 11364

[22] Filed: Apr. 14, 1975

[21] Appl. No.: 567,831

[52] U.S. Cl. ..... 225/47; 225/49; 225/50

[51] Int. Cl.² ..... B26F 3/02

[58] Field of Search ..... 225/39, 47, 48, 49, 225/53, 50; 221/70, 71

[56] References Cited

UNITED STATES PATENTS

| | | | |
|---|---|---|---|
| 2,790,609 | 4/1957 | Hawthorne et al. | 225/47 X |
| 3,102,671 | 9/1963 | Gershen | 225/48 X |
| 3,144,184 | 8/1964 | Yerkes | 225/47 X |
| 3,815,801 | 6/1974 | Perrin | 225/48 |

*Primary Examiner*—Stanley Tollberg
*Attorney, Agent, or Firm*—Martin A. Farber

[57] ABSTRACT

A tape dispenser comprising a front part including a cutting edge and two side parts including core members, respectively, the former being pivotally connected to the front part by living hinges. The core members include releasable snap locking parts for holding the core members together in a substantially parallel position of the two side parts.

6 Claims, 5 Drawing Figures

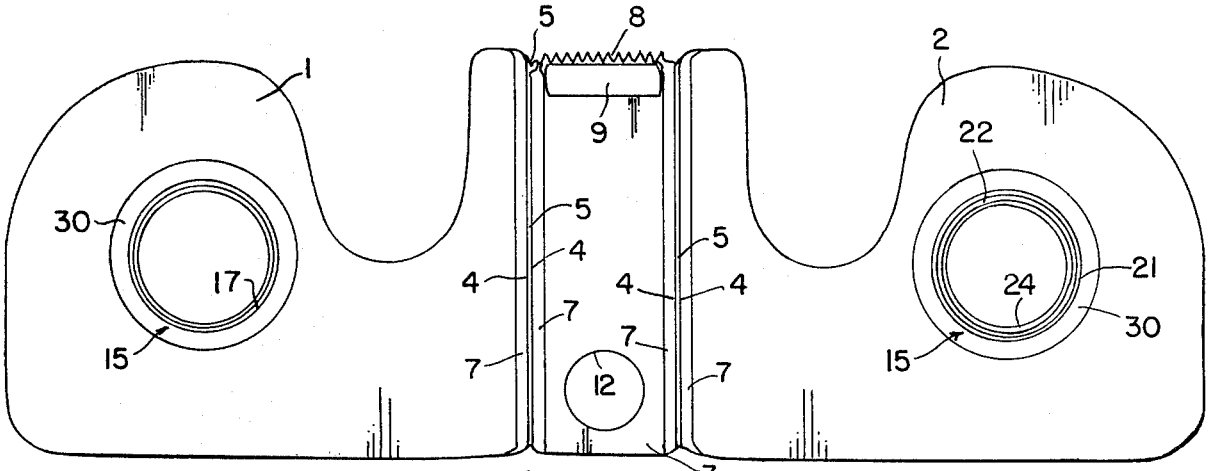
FIG. 1
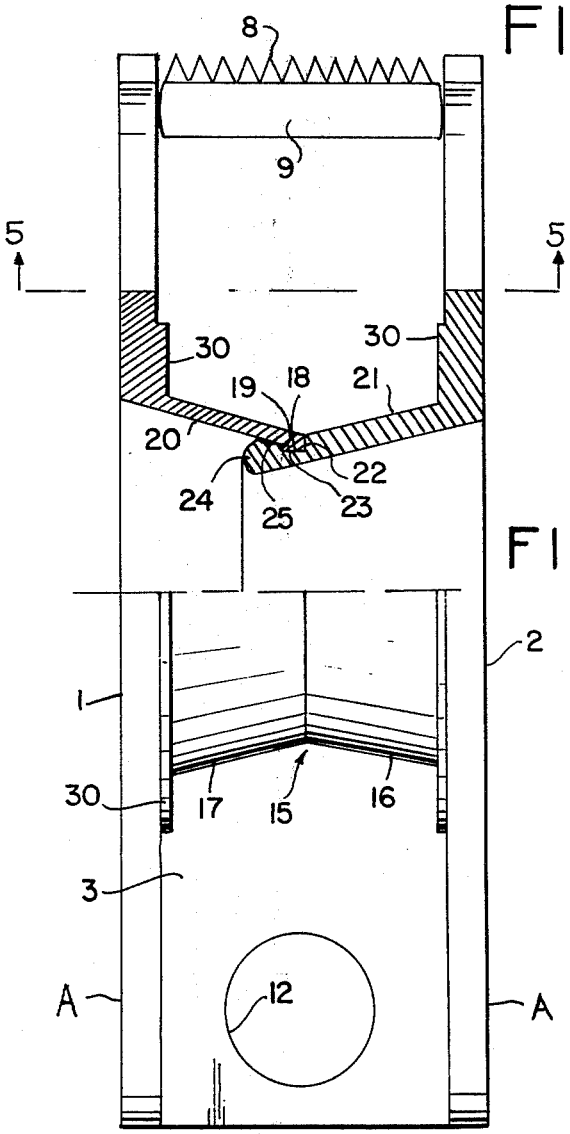
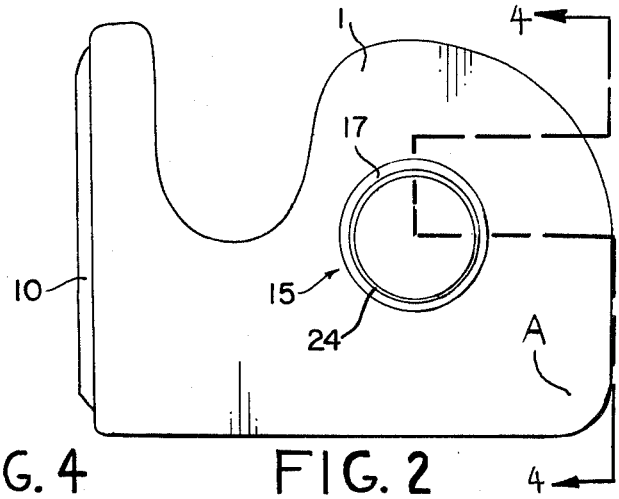
FIG. 4
FIG. 2
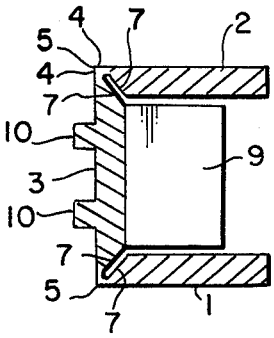
FIG. 5
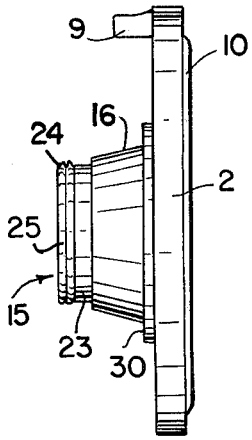
FIG. 3

TAPE DISPENSER HAVING SNAP LOCK CORE MEMBERS

The present invention relates to a tape dispenser in general, and to a roll tape dispenser, in particular.

It is an object of the present invention to provide a roll tape dispenser which is inexpensive to manufacture, yet exceptional in use and operability for the purpose of readily exchanging refill rolls of tape.

It is another object of the present invention to provide a roll tape dispenser in accordance with the above object comprising a hinge arrangement integrally joining all parts of the dispenser, in cooperation with a special snap-lock release formed in the roll holding portion.

With the above and other objects and advantages in view, the present invention will become more clearly understood in the following detailed description of a preferred embodiment form in connection with the accompanying drawings, of which:

FIG. 1 is a plan view of the inside of a tape roll dispenser in accordance with the invention in a fully opened position;

FIG. 2 is a side elevational view of the dispenser of FIG. 1 in the closed operative position of use;

FIG. 3 is a side view of FIG. 1;

FIG. 4 is a section taken along the lines 4 — 4 of FIG. 2 in enlarged view; and

FIG. 5 is a section taken along the lines 5 — 5 of FIG. 4.

Referring now to the drawing, a roll tape dispenser in accordance with the present invention comprises two side parts 1 and 2 of mirror-image contour symmetry joined together as a unit. In this respect the sides 1 and 2 are pivotally connected to a front piece 3 along parallel linear hinge edges 4 of the respective parts by living hinges 5. The entire unit is formed of a resilient synthetic material, such as, for example, polypropylene. The thickness of the hinges 5, which also are made of synthetic material, and preferably of the same material as that of the entire unit, is selected such as to make each hinge sufficiently flexible to act as a pivotal joint. For example, although not limited thereto, the thickness of the joint may be between approximately 0.006 to 0.007 inches with a polypropylene unit. The hinges 5 integrally are connected to the substantially larger thickness parts 3, 1 and 3, 2 of the unit, respectively. The edges 4 of the respective adjacent parts are beveled at 45 degree angles forming complementary adjacent portions 7, when the unit is pivoted into the operative position as illustrated in FIGS. 2, 4 and 5.

The front piece 3 is formed at the top thereof with a plurality of serrated tape cutting teeth 8 depending integrally from a tape resting edge 9. On the front surface of the front part 3 there are formed two parallel ridges 10 extending upwardly to substantially adjacent the teeth 8 and serving to receive thereon the cut edge of tape used in the dispenser, so as to facilatate its easy lift off for the next use. An opening 12 is formed in the bottom of the part 3 so that a lanyard may be secured therein, whereby the dispenser can be attached to the belt or like of the user or elsewhere, as may be desired.

A snap-lock release spindle 15 is integrally formed on the parts 1 and 3 comprising two frustoconical complementary core members 16 and 17, respectively, widening in a direction toward the walls of the parts 1 and 3, respectively. The core member 17 is formed at its free end with a substantially cylindrical inner surface 18 defining an abutment step 19 extending between the cylindrical surface 18 and the inner frustoconical surface 20 of the core member 17. The step 19 lies substantially perpendicularly to the axis 6 of the core members and faces the wall of the part 1.

The complementary core member 16, on its outer frustoconical surface 21 is formed with an annular abutment stop 22, which is centrally disposed perpendicularly to the axis 6 facing the part 1 in the operative position, and complementarily engages the free end of the core member 17. The outer surface of the core member 16 is recessed adjacent the stop 22, forming a cylindrical surface 23 against which the cylindrical surface 18 of the member 17 complementarily engages in the snap locked position as shown in FIG. 4. The outer surface of the core member 16 continues toward its free end in a radially outwardly extending flange 24, which may be roughened with circumferential grooves or ridges 25. The flange 24 snaps in locking engagement against the inner frustoconical surface 20 of the core member 17, abuttingly held against the abutment step 19, and aided in this position by the roughened means 25 pressing against the inner narrowing surface 20. In the snap locked position the outer surfaces of the core members 16 and 17 precisely symmetrically meet in a slight frustoconical incline, no more than a few degrees, reducing the rolling friction of a tape roll (not shown) to be used in the dispenser on the spindle 15, the latter acting as a "self-lubricating" core for the tape roll.

On the facing walls of the parts 1 and 2 adjacent the widest portions of the core members 16 and 17 and integral therewith, there are formed raised cylindrical portions 30, which reduce the possibilities of the edges of a tape roll sticking against the walls of the parts 1 and 2.

The unit of the present invention is readily opened and released from the locked FIGS. 2 and 4 position, by simply pressing the rear bottom corners A of the parts 1 and 2 with the thumb and forefinger. This causes the core members 16 and 17 to disengagingly snap apart. This action is aided by the cooperative structure of the core members and the hinging of the parts 1 and 2 to the part 3. The parts 1 and 2 may then be swung sufficiently apart in order to remove a used roll of tape and to replace it with a new roll on one of the core members.

The unit of the present invention is, likewise due to its cooperative structure, readily snap locked with the new roll thereon. In this respect the parts 1 and 2 are pivoted into the position shown in FIG.5, whereupon the core members 16 and 17 are coaxially aligned with free ends thereof touching one another. Upon light pressing of the parts 1 and 2 toward each other, the resiliency of the core members, and particularly the resiliency due to the narrowed thickness portions thereof, for example, adjacent the stop 22, permits the male core member 16 to snap into the core member 17, into complementary locking engagement as illustrated in FIG. 4 and described hereinabove. Due to the resiliency of the core members and their structure, radial pressing forces also serve to hold the core members in a stable fixed condition during use.

The unit of the present invention may be inexpensively manufactured by mass injection molding processes.

The herein described embodiment of the invention, has been given by illustration only and not in a limiting sense.

I claim:

1. Tape dispenser, comprising a rectangular vertical oriented front part having an uppermost immoveable rigidly attached integral cutting edge and having elongated vertical lateral hinge edges extending integrally from said uppermost cutting edge.

two side parts each including a core member, each of said side parts including an elongated front hinge edge of a length larger than and extending adjacent to the entire length of said lateral hinge edges and extending above said cutting edge of said front part, with said cutting edge therebetween and with said lateral hinge edges between, said front hinge edges of each of said side parts, respectively, hinge means constituting a flexible synthetic material for integrally pivotally connecting each of said front hinge edges of each of said parts, respectively, to a different one of said lateral hinge edges of said front part, extending along the entire length of said lateral hinge edges inclusing adjacent said cutting edge, said core members including releasable snap locking means for holding said core members together in a substantially parallel position of said two side parts, and said side parts each include a rear free end remote from said front hinge edge, said core members being located intermediate to said rear free ends of said side parts respectively and said front hinge edges respectively, said rear free ends of both of said side parts constituting in cooperation with said releasable snap locking means, a snap releasing means for releasing said core members from each other upon pressing of said rear free ends toward each other.

2. Tape dispenser, as claim 1, wherein said parts are made of the same synthetic material as that of said hinge means, and have a thickness substantially greater than that of said hinge means so as to be substantially rigid yet resilient.

3. Tape dispenser, as in claim 2, wherein said synthetic material is polypropylene.

4. Tape dispenser, as claim 2, wherein said parts are beveled adjacent said hinge means to form substantially complementary adjacent portions on adjacent of said parts, respectively, in said parallel position.

5. Tape dispenser, as claim 4, wherein said core members are frustoconically shaped and narrow in a direction towards each other, and are coaxially disposed in said parallel position, and said snap locking means comprises a radially outwardly extending flange integrally formed on one of said core members, and a complementary abutment step forming a thickened radially inwardly extending end portion of the other of said core member, for snap locking complementary yieldable engagement of said one core member in said other core member.

6. Tape dispenser, as claim 5, wherein said radially inwardly extending end portion has an inner substantially cylindrical surface between said abutment step and a free end of said other core member, and said one member forms a radially inwardly directed recess having an abutment stop at a portion thereof abutting said free end of said other core member in said parallel position constituting a snap locked position, said recess being formed adjacent said flange and having a cylindrical surface between said flange and said abutment stop on which said thickened radially inwardly extending end portion of said other core member complementarily abuts in said snap locked position of said core members.

* * * * *

UNITED STATES PATENT OFFICE
CERTIFICATE OF CORRECTION

Patent No. 3,972,459 Dated August 3, 1976

Inventor(s) Daniel J. Cooper

It is certified that error appears in the above-identified patent and that said Letters Patent are hereby corrected as shown below:

The middle initial of the inventor should read:

-- J. --.

Column 3, line 24, "inclusing" should read -- including --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*